US006641469B2

(12) United States Patent
Deshler

(10) Patent No.: US 6,641,469 B2
(45) Date of Patent: Nov. 4, 2003

(54) SANDING BLOCK HAVING CONTOURED GRIP

(76) Inventor: Donald T. Deshler, 414 N. Cambridge St., Orange, CA (US) 92866

( * ) Notice: Subject to any disclaimer, the term of this patent is extended or adjusted under 35 U.S.C. 154(b) by 13 days.

(21) Appl. No.: 10/006,613

(22) Filed: Nov. 30, 2001

(65) Prior Publication Data

US 2003/0104777 A1 Jun. 5, 2003

(51) Int. Cl.[7] ..... B24D 17/00

(52) U.S. Cl. ..... 451/514; 451/517; 451/519; 451/524

(58) Field of Search ..... 451/514, 490, 451/502, 503, 509, 517, 518, 519, 520, 521, 522, 523, 524, 525

(56) References Cited

U.S. PATENT DOCUMENTS 2,457,076 A * 12/1948 Williams et al. ..... 451/522
3,822,518 A * 7/1974 Sjostrand ..... 451/516
3,973,362 A * 8/1976 Groshans ..... 451/516
4,030,254 A * 6/1977 Marcantonio ..... 451/516
5,512,010 A * 4/1996 Labad, Jr. ..... 451/344
5,902,176 A * 5/1999 Chen ..... 451/524
6,095,911 A * 8/2000 Edens ..... 451/524

* cited by examiner

*Primary Examiner*—Dung Van Nguyen
(74) *Attorney, Agent, or Firm*—Roy A. Ekstrand

(57) ABSTRACT

A sanding block includes a generally rectangular base housing upon which a multiply contoured generally convex hand grip is secured. The hand grip further defines inwardly extending concave portions which facilitate easy and secure grip by the user. An over-center lever clamp mechanism is operative at each end of the sanding block to secure the opposed ends of a sandpaper sheet in a releasable attachment.

16 Claims, 5 Drawing Sheets

SANDING BLOCK HAVING CONTOURED GRIP

FIELD OF THE INVENTION

This invention relates generally to apparatus for abrasive sanding and particularly to handheld or manual sanding tools.

BACKGROUND OF THE INVENTION

For many years, industries such as automobile body work and repair have relied heavily upon the use of abrasive sanding apparatus to obtain the desired shaping and surface qualities upon the finished product. While initially the work of sanding and shaping the automobile bodies relied heavily upon burdensome hand or manual sanding, the advent of power-driven sanders such as electric or pneumatic powered devices substantially reduced the amount of burdensome and labor intensive hand sanding carried forward. However, despite the steady improvement of power sanding apparatus, a substantial portion of the typical automobile body repair and shaping remains optimally performed using manual or hand sanding.

The primary tool employed in much of the hand sanding operations is known generally in the art as a "sanding block". While the design and fabrication of sanding blocks has been subject to substantial variation, all typical sanding blocks include the common elements of a hand block or grip, a work surface which is often flat and rectangular, a quantity of abrasive sand paper, sheets or strips and a mechanism for securing the sandpaper upon the work surface.

Not surprisingly, the continuing use of hand sanding apparatus and the continuing need for improved sanding blocks has prompted practitioners in the art to develop a virtually endless variety of sanding blocks. For example, U.S. Pat. No. 6,062,966 issued to Ali et al. sets forth a SANDING BLOCK having a generally rectangular body supporting a curved generally cylindrical hand grip. The body and grip are joined at a center transverse rib and are separated by a gap therebetween. Within the gap, apparatus such as pointed shafts much like the end of conventional nails are supported and extend through the gap. The sanding block is formed of a resilient flexible material such as rubber or plastic allowing the cylindrical grip portion to be deformed away from the gap during the attachment of a sandpaper sheet. When attached, the sandpaper sheet extends across the work surface with the end portions curling upwardly and into the gap to be secured in place by the pointed shafts.

U.S. Pat. No. 5,863,243 issued to Ali forms the parent patent for the above described U.S. Pat. No. 6,062,966 and discloses a SANDING BLOCK which is substantially identical to the above described sanding block. The functional difference of the sanding block in U.S. Pat. No. 5,863,243 is provided by an intermediate portion which is interposed between the curved or cylindrical grip member and the working block portion.

U.S. Pat. No. 5,245,797 issued to Milkie sets forth a MANUAL SNDER having a block for holding a sheet of sandpaper and a housing which may be attached to the block. The block defines two ridges each with a convex top surface. The two ridges are proximate opposed sides of the block and a shaft projects from the block inwardly and adjacent to each ridge. An inverted box-shaped member associated with each ridge defines an elongated slot which receives the shaft such that the box member is able to secure the sandpaper sheet.

U.S. Pat. No. 5,512,010 issued to Labad, Jr. sets forth a WET SANDING BLOCK having a sanding block and a work surface formed on the underside thereof. The work surface supports a sheet of wet for dry sand paper and a pair of end clips for securing the end portions of the sandpaper to the block. The interior of the block defines a hollow chamber within which a plurality of apertures are formed to facilitate downward flow downwardly to the working surface and the sandpaper sheet. A flexible hose is joined to the block in communication with a supply of water under pressure.

U.S. Pat. No. 5,383,308 issued to Beloff et al. sets forth a SANDING BLOCK formed of two block portions which are joined by a spring mechanism. The spring mechanism urges the two block portions outwardly toward an extended position. An endless belt of abrasive sandpaper encircles the block members and is maintained in tension by the spring expanders.

U.S. Pat. No. 5,172,524 issued to Poss sets forth a SANDING BLOCK having a rectangular housing supporting a supplementary block housing and an expanding spring-driven attachment therebetween. An endless belt of sandpaper encircles the housing and supplemental block member which is maintained in tension by the spring-driven expander.

U.S. Pat. No. 4,478,011 issued to Russell sets forth a HAND SANDER having a sanding block structure which includes storage means for an elongated strip of abrasive material. The sander includes a pusher for driving a portion of the abrasive strip over a work piece wherein the storage means for the abrasive strip and the working surface are carried on a cassette structure which is readily separable as a unit from the pusher.

U.S. Pat. No. 4,249,349 issued to Rueb sets forth an ELONGATE SANDING BLOCK having a handle portion from which an elongate support portion projects. The support portion includes means for adherence of a strip of pressure-sensitive adhesive-coded finishing material. The support portion has variously shaped surface facets for supporting the finishing material which include a planar surface portion, an arcuate surface portion and an edge portion.

U.S. Pat. No. 5,337,523 issued to Walsh sets forth a UTILITY TOOL having a hand sander which includes a handle and a plurality of interchangeably fitted inserts securable to the handle. The inserts form an exterior surface for supporting sandpaper or the like which is contoured to match a particular surface detail of a vehicle body or other work piece.

U.S. Pat. No. 4,501,096 issued to Lukianoff and a continuation-in-part thereof issued as U.S. Pat. No. 4,640,060 also issued to Lukianoff each set forth a HAND HELD SANDING DEVICE having a block defining a pair of perpendicular planar surfaces together with mutually perpendicular end surfaces and a cylindrical surface completing the block. The cylindrical surface defines an inwardly extending slot which receives the end portions of a sandpaper sheet wrapped around the block such that the sandpaper sheet ends are inserted into the slot.

U.S. Pat. No. 4,887,396 issued to Lukianoff sets forth a DISPOSABLE SANDING DEVICE fabricated of a block of light-weight resilient material capable of substantially retaining its shape under applied sanding pressure which has a relatively permanent abrasive outer surface formed thereon.

While the foregoing described prior art devices have to some extent improved the art and have in some instances enjoyed commercial success, there remains nonetheless a continuing need in the art for ever more improved hand sanding blocks which facilitate the secure attachment and easy removal of sandpaper while providing a comfortable and secure hand grip.

SUMMARY OF THE INVENTION

Accordingly, it is general object of the present invention to provide an improved hand sanding block. It is a more particular object of the present invention to provide an improved hand sanding block which facilitates the secure attachment and easy removal of sandpaper or other abrasive sheets. It is a still more particular object of the present invention to provide an improved hand sanding block which is relatively comfortable in the user's hand while being simultaneously secured in the users grip for ease of use and hand control.

In accordance with the present invention there is provided a sanding block comprising: an elongated hand grip defining a pair of opposed ends, a convex raised portion, a pair of concave portions on each end thereof and a pair of raised ends; an elongated base housing secured to the hand grip and having a pair of angled end surfaces aligned with the opposed ends of the hand grip and having a support surface; a pair of retractable sandpaper clamps supported at the opposed ends each movable between an extended position and a retracted position; and a pair of lever means each operatively coupled to one of the retractable sandpaper clamps for moving the retractable sandpaper clamps between the retracted and extended positions, the lever means each including an over-center latch for securing the retractable sandpaper clamps in the retracted positions.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
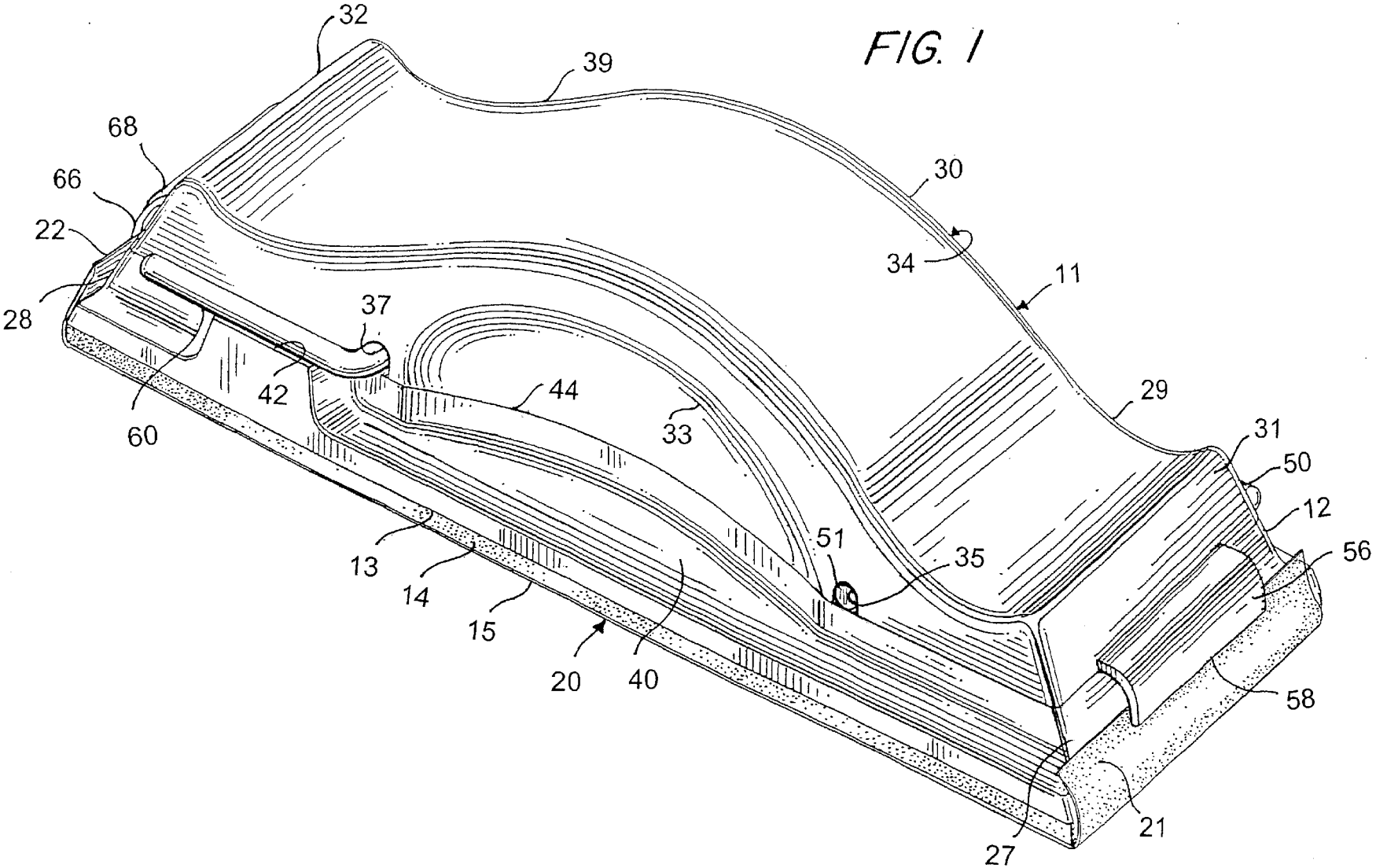
FIG. 1 sets forth a perspective view of a sanding block constructed in accordance with the present invention and having a sheet of sandpaper secured thereto.

FIG. 1 sets forth a perspective view of a sanding block having a contoured grip constructed in accordance with the present invention and generally referenced by numeral 10. Sanding block 10 comprises four basic components which include a contoured hand grip 11, a base housing 12 and a pair of clamping mechanisms supported at each end thereof and terminating in clamps 56 and 66 for securing a rectangular piece of sandpaper 20. In accordance with an important aspect of the present invention, hand grip 11 is multiply curved to provide a comfortable grip for the user's hand while facilitating control during use. The operative mechanism for securing sandpaper 20 via clamps 56 and 66 utilizes a novel "over-center" clamping action. In this manner, sandpaper is securely retained upon the present invention sanding block and is readily changed without undue interruption of its use.

More specifically, sanding block 10 includes a handle grip 11 preferably formed of a light-weight but rigid material such as molded plastic or the like. Hand grip 11 is, as mentioned above, multiply contoured and includes a raised convex portion 30 at the approximate center of hand grip 11 which terminates in a pair of concave portions 29 and 39 at each end thereof. Concave portions 29 and 39 further terminate in raised end portions 31 and 32 respectively. Hand grip 11 further defines a pair of inwardly extending concave portions 33 and 34 on each side of raised portion 30. Raised end portion 31 defines a channel 71 through which a clamp 56 extends. Similarly, and as is better seen in FIG. 2, raised end 32 defines a channel 81 through which clamp 66 extends. A passage 37 is formed in hand grip 11 beneath concave portion 39 while a similar passage 35 is formed beneath concave portion 29. As is better seen in FIG. 5, hand grip 11 further defines a passage 36 on the opposite side of hand grip 11 aligned with passage 35 and a passage 38 also positioned on the opposite side of hand grip 11 aligned with passage 37. As is also better seen in FIG. 5, sanding block 10 includes a lever 50 having shaft portions 52 and 54 received within passages 35 and 36 respectively together with a lever 60 having shaft portions 62 and 64 received within passages 38 and 37 respectively. The operation of levers 50 and 60 manipulate clamps 56 and 66 respectively for retaining sandpaper 20.

Base housing 12 defines an angled surface 27 aligned with the angled surface of raised end 31 and an angled surface 28 aligned with the angled surface of raised end 32. Base housing 12 further defines a pair of guide surfaces 40 and 41 (surface 41 seen in FIG. 2) respectively aligned with concave portions 33 and 34. The function of guard surfaces 40 and 41 is set forth below in greater detail. However, suffice it to note here, that guard surfaces 40 and 41 protect the gripping fingers of the user from contact with the work surface or abrasive materials during the sanding process. In addition, guard surfaces 40 and 41 facilitate the application of pressure and control of the sanding block during use. Base housing 12 further defines a stop 42 which limits the downward travel of lever 60. As is better seen in FIG. 2, base housing 12 defines a similar stop 43 which limits the downward travel of lever 50.

In the embodiment of the present invention shown in FIG. 1, base housing 12 defines a generally rectangular generally planar support surface 13 on the underside thereof. It will be apparent to those skilled in the art however, that the rectangular character of sanding block 10 and the planar character of support surface 13 are illustrative of the present invention sanding block but are by no means limiting. Thus, it will be understood that differently shaped support surfaces may be used in place of the generally planar generally rectangular character of support surface 13. For example, support surface 13 may be round or oval in character without departing from the spirit and scope of the present invention. By further example, support surface 13 may be curved in a concave or convex manner as desired without departing from the spirit and scope of the present invention. The important function of support surface 13 is to provide a transfer of the applied work force from hand grip 11 to the surface being worked.

Sanding block 10 further includes a resilient pad 14 preferably formed of a resilient material such as foam rubber or plastic or the like. Alternatively, depending upon the application persuade, resilient pad 14 may be a firmer material such as rubber or resilient plastic. By way of further alternative, resilient pad 14 may be extremely firm or even rigid in certain applications.

Clamps 56 and 66 are substantially identical in structure and are set forth below in FIGS. 4 and 5 with greater detail. Suffice it to note here, that clamp 56 extends outwardly through channel 71 and defines a downwardly curved end 58. Similarly, clamp 66 extends outwardly through channel 81 (seen in FIG. 2) and defines a downwardly curved end 68. Curved ends 58 and 68 provide a pair of clamping edges which grip ends 21 and 22 respectively of an elongated rectangular sheet of sandpaper 20. The grip of curved ends 58 and 68 is secure and extremely tight due to the above mentioned over-center clamping action provided by levers 50 and 60 respectively. Suffice it to note here, that curved ends 58 and 68 secure sandpaper 20 in a solid but releasable attachment upon sanding block 10.

In operation, the user positions sandpaper 20 such that ends 21 and 22 extend outwardly from each side of sanding block 10. Thereafter, the user pivots levers 50 and 60 upwardly to the position shown for lever 60 in FIG. 3. By means set forth below in greater detail, the upward pivotal movement of levers 50 and 60 extends clamps 56 and 66 outwardly from angled surfaces 27 and 28. Thereafter, end 21 is folded upwardly beneath curved end 58 while end 22 is similarly folded upwardly beneath curved end 68. Thereafter, levers 50 and 60 are pivoted downwardly to the position shown in FIG. 1, drawing clamps 56 and 66 into sanding block 10 and securing ends 21 and 22 against angled surfaces 27 and 28 respectively. Thereafter, with sandpaper 20 securely attached the user undertakes the typical sandpaper operations.

Figure 3:
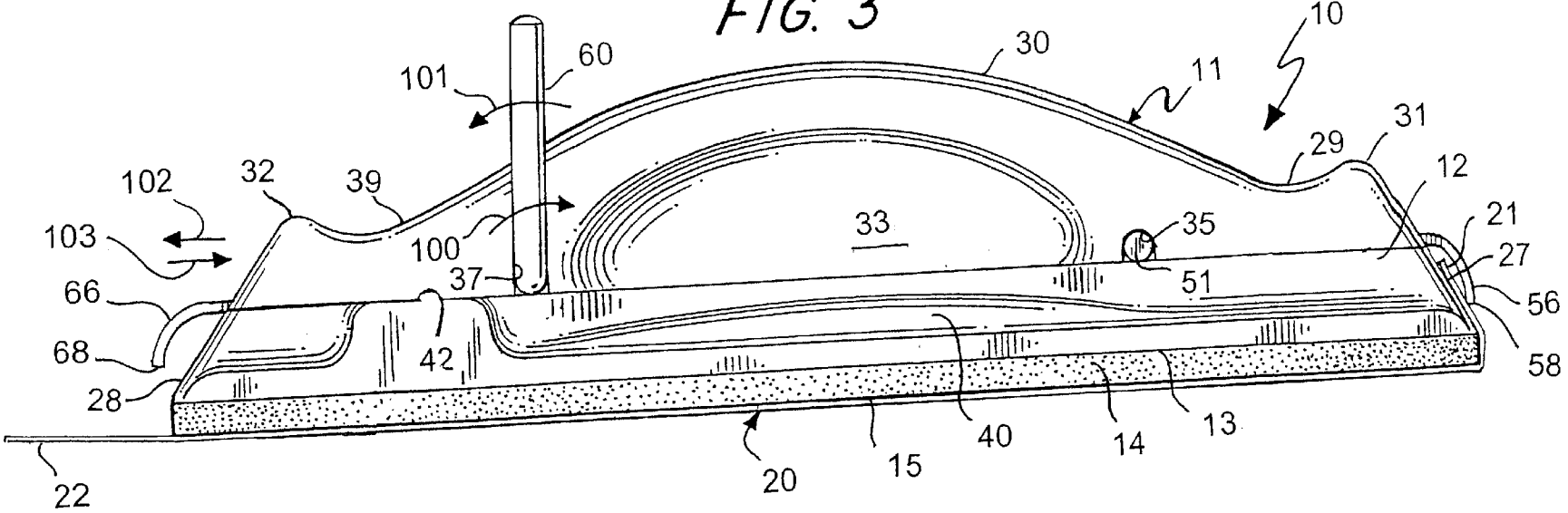
FIG. 3 sets forth a side elevation view of the present invention sanding block at the intermediate attachments stage shown in FIG. 2.

Once the user has expended the abrasive qualities of sandpaper 20 or other wise desires to change sand paper, the user again pivots levers 50 and 60 upwardly to their raised position such as that shown for lever 60 in FIG. 3 which in turn moves clamps 56 and 66 outwardly releasing ends 21 and 22 of sandpaper 20. Thereafter, the next sheet of sandpaper is attached in the above manner and the user continues operation. In accordance with an important aspect of the present invention, sanding block 10 provides a compact tightly collected structure during the sanding operation which maintains sandpaper 20 in a secure attachment while compacting clamps 56 and 66 together with levers 50 and 60 in closed positions which avoid potentially harmful extending components as are typically found in most prior art devices.

Figure 2:
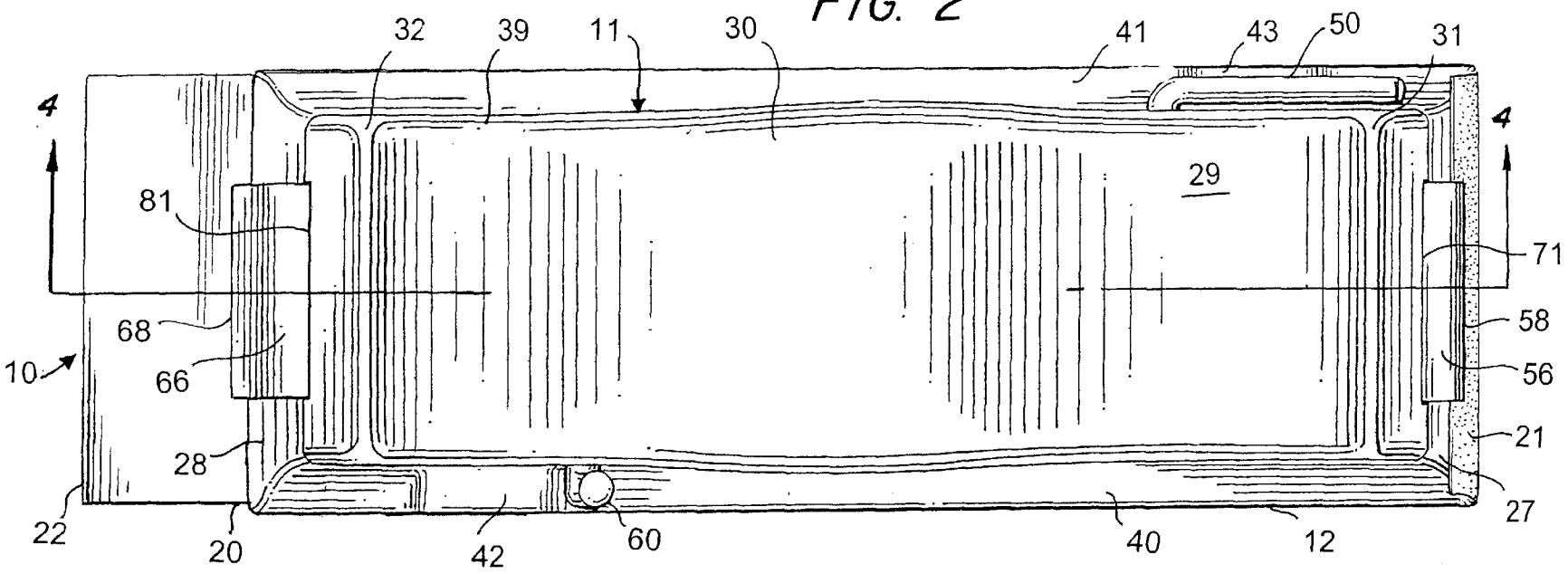
FIG. 2 sets forth a top plan view of the present invention sanding block having a sheet of sandpaper being secured thereto.

FIG. 2 sets forth a top view of sanding block 10 at the midpoint of sandpaper attachment or removal. As described above, sanding block 10 includes a hand grip 11 secured to a base housing 12. Hand grip 11 defines a raised portion 30 together with a pair of concave portions 29 and 39 and a pair of raised ends 31 and 32. Base housing 12 defines a pair of guard surfaces 40 and 41 on each side of raised portion 30. As is better seen in FIG. 5, raised portion 30 further defines a pair of inwardly extending concave portions 33 and 34. A pair of channels 71 and 81 are formed in raised end portions 31 and 32 respectively. A pair of clamps 56 and 66 having respective curved ends 58 and 68 extend outwardly through channels 71 and 81. A pair of levers 50 and 60 are operatively coupled to clamps 56 and 66 respectively in the manner set forth below in FIGS. 4 and 5. Suffice it to note here, that levers 50 and 60 control the extension or retraction of clamps 56 and 66.

Base housing 12 further defines angled end surfaces 27 and 28 which extend downwardly from the angled portions of raised ends 31 and 32. Base housing 12 further defines a pair of stop surfaces 42 and 43 which limit the rotational travel in the downward direction of levers 50 and 60.

In the configuration shown in FIG. 2, a rectangular sheet of sandpaper 20 having ends 21 and 22 is positioned beneath sanding block 10 and has end 21 secured by clamp 56 while end 22 is free. The position of lever 60 in its raised position extends clamp 66 outwardly removing curved end 68 from angled surface 28. Thus, clamp 66 is shown in its open position while in contrast, clamp 56 is shown in its closed or retracted position. As will be seen, the opening or closing of clamps 56 and 66 is controlled solely by levers 50 and 60 respectively. In the configuration shown in FIG. 2, the user may remove sandpaper 20 by pivoting lever 50 upwardly which extends clamp 56 and releases end 21 in the manner shown for clamp 66. Alternatively, the user may fold end 22 upwardly beneath curved end 68 against angled surface 28 and thereafter pivot lever 60 downwardly against stop 42. This action draws clamp 66 inwardly to the retracted position shown for clamp 56 and secures curved end 68 against end 22 of sandpaper 20.

FIG. 3 sets forth a side elevation view of sanding block 10 in the configuration shown in FIG. 2. Thus, it will be recalled that clamp 56 is shown in its retracted or closed position while clamp 66 is shown in its extended or open position. This facilitates illustration of the action of clamps 56 and 66 in response to pivotal movement of levers 50 and 60.

More specifically, sanding block 10 includes a hand grip 11 defining a raised portion 30 and a pair of concave portions 29 and 39 on each side thereof. A pair of raised ends 31 and 32 are formed on each end of hand grip 11. A pair of concave portions 33 and 34 (concave portion 34 seen in FIG. 5) are formed beneath raised portion 30. Hand grip 11 further defines a pair of passages 35 and 37 within which levers 50 and 60 are received. As is set forth above in FIG. 2, hand grip 11 further defines a pair of channels 71 and 81 through which a pair of clamps 56 and 66 respectively extend.

Sanding block 10 further includes a base housing 12 defining angled surfaces 27 and 28 at each end thereof. Base housing 12 further defines a pair of guard surfaces 40 and 41 (surface 41 seen in FIG. 2) together with a pair of stop surfaces 42 and 43 (stop 43 shown in FIG. 2). Base housing 12 further defines a generally planar support surface 13 upon which a resilient pad 14 is secured. Pad 14 may be attached using a variety of conventional fastening apparatus. However, it has been found particularly advantageous to secure pad 14 to support surface 13 using a contact type adhesive. This allows pad 14 to be easily removed and changed.

In the configuration shown, and as is mentioned above, clamp 56 is shown in its closed or retracted position such that curved end 58 captivates end 21 of a sandpaper sheet 20 against angled surface 27. Conversely, and as is also set forth above, clamp 66 is shown in its open or extended position. Correspondingly, lever 60 is shown pivoted upwardly in the direction indicated by arrow 100. By means set forth below in greater detail, the pivoting of lever 60 to its raised position in the direction indicated by arrow 100 extends clamp 66 outwardly in the direction indicated by arrow 102. Thus, end 22 may be bent upwardly and inserted between curved end 68 of clamp 66 and angled surface 28 of base housing 12. Thereafter, pivoting lever 60 downwardly in the direction indicated by arrow 101 draws clamp 66 inwardly in the direction indicated by arrow 103 captivating end 22 of sandpaper 20 against angled surface 28. This completes the attachment of sandpaper 20. As is also mentioned above, removal of sandpaper 20 is accomplished in the reverse fashion by simply again pivoting lever 60 upwardly in the direction indicated by arrow 100 to release clamp 66 and thereafter pivot lever 50 (seen in FIG. 2) to a similar upward position releasing clamp 56. In this manner it will be noted that sandpaper change is accomplished in a very simply straight forward manner without unduly delaying the continuation of the work process.

Figure 5:
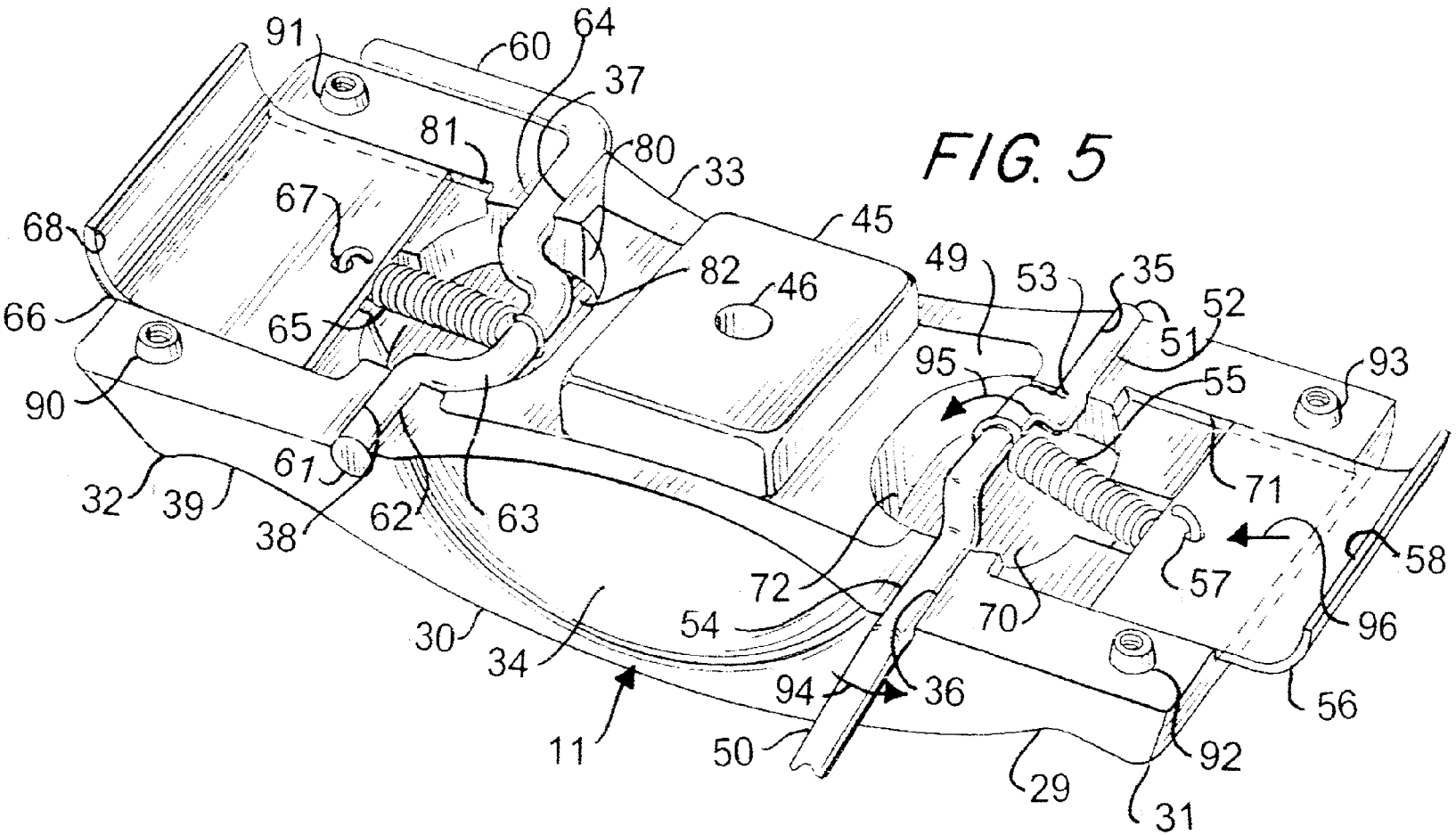
FIG. 5 sets forth a partial perspective view of the sandpaper attachment mechanism of the present invention sanding block.

As mentioned above, the position of guard surfaces 40 and 41 (surface 41 seen in FIG. 2) protects the users fingers as they grip concave portions 32 and 34 (portion 34 seen in FIG. 5). In addition, surfaces 40 and 41 provide a convenient surface for manipulating the edge portions of the present invention sanding block.

Figure 4:
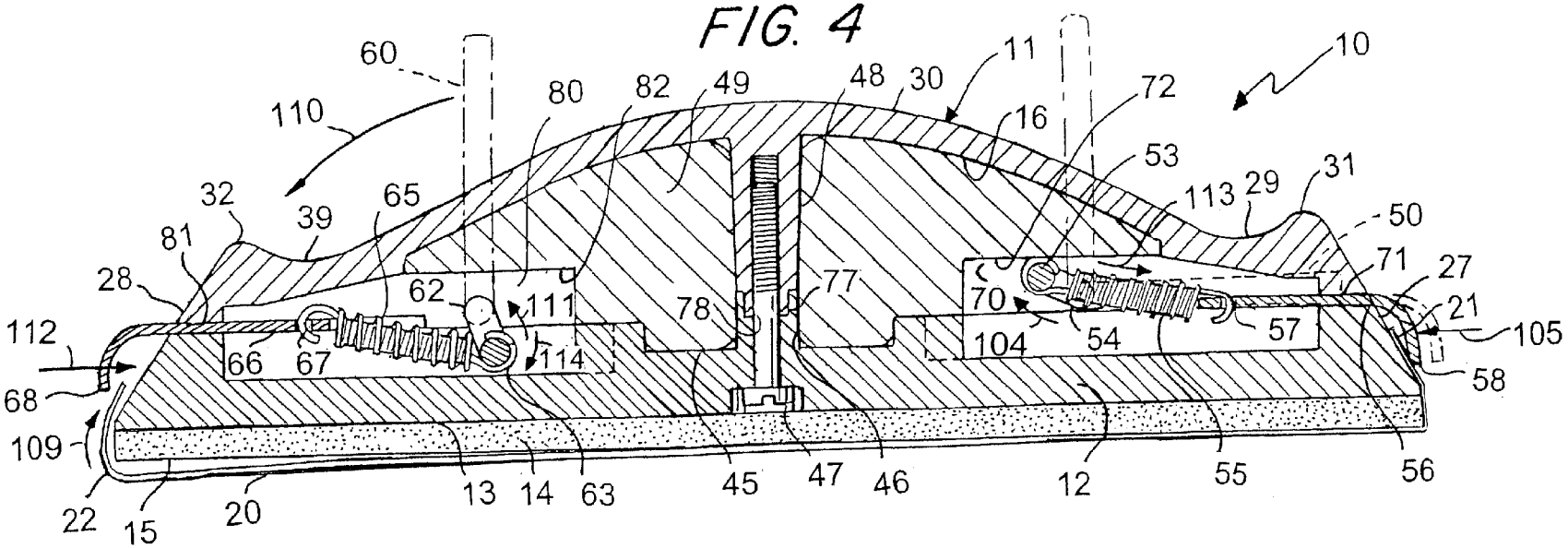
FIG. 4 sets forth a section view of the present invention sanding block taken along section lines 4—4 in FIG. 2.

FIG. 4 sets forth a section view of sanding block 10 taken along section lines 4—4 in FIG. 2. By way of overview, and to better facilitate illustration of the sandpaper clamping mechanism of the present invention sanding block, clamp 56 is shown in its retracted or closed position while clamp 66 is shown in its extended or open position. It will be understood that the action of clamps 56 and 66 in response to levers 50 and 60 respectively is substantially identical.

More specifically, sanding block 10 includes a hand grip 11 preferably fabricated of a molded plastic material or the like which defines a raised portion 30 having concave portions 29 and 39 on either side thereof. A pair of raised ends 31 and 32 are formed on each end of hand grip 11. Hand grip 11 further defines an interior cavity 16 within which an insert 49 is formed. Insert 49 is preferably formed of a light-weight low-density material to provide sufficient buoyancy for sanding block 10 to cause to the sanding block to float when immersed in water. Alternatively, insert 49 may be fabricated of a higher strength material to further strengthen raised portion 30. Insert 49 defines a downwardly extending boss 45. A threaded boss 48 extends downwardly through interior cavity 16 from raised surface 30 and receives a conventional fastener 47 which is threaded into boss 48. Hand grip 11 further defines a pair of channels 71 and 81 at each end thereof extending outwardly beneath raised ends 31 and 32 respectively. Hand grip 11 further defines a pair of interior cavities 70 and 80 which, as is better seen in FIG. 5, are positioned between passages 35 and 36 and passages 37 and 38 respectively.

Hand grip 10 further includes a base housing 12 having angled end surfaces 27 and 28 and a generally planar work surface 13. A boss 77 extends upwardly through aperture 46 formed in insert 49 to join threaded boss 48 of hand grip 11. The underside of base housing 12 further defines a recess which receives the head of faster 47. Fastener 47 passes upwardly through aperture 78 formed in boss 77 and is threadably received within boss 48 to secure bass housing 12 to hand grip 11. A resilient pad 14 is secured to surface 13 by convenient attachment such as adhesive attachment or the like.

As is better seen in FIG. 5, lever 50 includes a pair of shafts 52 and 54 which extend through passages 35 and 36 respectively to be rotatably supported upon hand grip 11. As is also better seen in FIG. 5, a crank 53 having an offset relationship to shafts 52 and 54 extends between shafts 52 and 54 and is movable within interior cavity 70 as lever 50 is rotated. Similarly, and as is also better seen in FIG. 5, lever 60 includes shafts 62 and 64 rotatably supported within passages 38 and 37 respectively. A crank 82 formed in offset relationship to shafts 62 and 64 joins shafts 62 and 64 and is movable within interior cavity 80.

A clamp 56 having a curved edge 58 extends inwardly through channel 71 and defines an interior aperture 57. A coil spring 55 is coupled to clamp 56 at aperture 57 with the remaining end of spring 55 being coupled to crank 53. In a similar fashion, clamp 66 extends inwardly through channel 81 and defines an aperture 67. A coil spring 65 is coupled to aperture 67 of clamp 66 at one end with the remaining end coupled to crank 63.

In operation, and by way of overview, it will be noted that the cooperation of the offset crank and coil spring of each clamp assembly operative upon each of clamps 56 and 66 provides an over-center operation in the retracted or closed position of the clamp. This provides a self-locking feature for the clamp mechanism and greatly simplifies the opening and closing of the clamp. In addition, this over-center characteristic ensures that the clamp retains the sandpaper material in a positive secure attachment.

More specifically, lever 50 and crank 53 thereof are shown in the closed or retracted position for clamp 56. Accordingly, curved edge 58 of clamp 56 securely grasps end 21 of sandpaper 20 against angled surface 27. It will be noted that in the position shown in which the outer end of lever 50 rest upon stop 43 (seen in FIG. 2), crank 53 is rotated in the direction indicated by arrow 104 beyond direct alignment with shaft 54. As a result, the spring force of spring 55 urges crank 53 in the direction indicated by arrow 113. Simultaneously, spring 55 draws clamp 56 inwardly urging curved edge 58 against end 21 of sandpaper 20 in the direction indicated by arrow 105. As a result, the positioning of lever 50 allows this over-center positioning of crank 53. The release of clamp 56 requires a significant rotational force upon lever 50 pivoting it upwardly and overcoming the force of spring 55.

Clamp 66, spring 65 and crank 63 of lever 60 are shown in the open or extended position. Thus, the rotation of lever 60 to the raised position shown in phantom line depiction rotates crank 63 in the direction indicated by arrow 114. This rotation of crank 63 releases the tension of spring 65 and allows curved end 68 of clamp 66 to be moved outwardly away from angled surface 28. In this position, end 22 of sandpaper sheet 20 may be moved inwardly and upwardly as indicated by arrow 109 to position a portion of end 22 beneath curved end 68 of clamp 66. Once end 22 is appropriately positioned against angled surface 28, the user simply pivots lever 60 downwardly in the direction indicated by arrow 110. The downward pivotal movement of lever 60 rotates crank 63 about shaft 62 in the direction indicated by arrow 111. The rotation of crank 63 draws spring 65 into tension which in turn draws clamp 66 inwardly in the direction indicated by arrow 112. The continued rotation of lever 60 moves crank 63 over-center with respect to shaft 62 providing the secure over-center. Attachment shown in the positioning of lever 50 and crank 53. As a result, curved end 68 captivates end 22 of sandpaper sheet 20 against angled surface 28.

FIG. 5 sets forth a perspective view of hand grip 11 together with clamps 56 and 66, levers 50 and 60 and their respective spring mechanisms viewed with base housing 12 removed In an underside view. As described above, sanding block 10 includes a hand grip 11 having concave portions 33 and 34 together with a raised portion 30 formed therein. As is also described above, a pair of concave portions 29 and 39 together with raised portions 31 and 32 are formed on each end of hand grip 11. Hand grip 11 also defines a pair of channels 71 and 81 which receive clamps 56 and 66 respectively in a sliding attachment. Clamp 56 defines a curved end 58 while clamp 66 defines a curved end 68. A plurality of locating bosses 90 through 93 are positioned at the approximate corners of hand grip 11 to provide location and attachment between hand grip 11 and base housing 12 (seen in FIG. 4). Hand grip 11 further supports an insert 49 having an upwardly extending boss 45 formed therein. An aperture 46 is formed at the approximate center of boss 45.

A lever 50 includes a pair of shafts 52 and 54 together with an offset crank 53 rotatably supported within passages 35 and 36 of hand grip 11. A spring 55 is coupled to crank 53 at one end with the remaining end secured to clamp 56 by an aperture 57 formed therein. Similarly, a lever 60 is rotatably supported by shaft portions 62 and 64 within passages 38 and 37 of hand grip 11. An offset crank portions 63 is formed between shafts 62 and 64. A coil spring 65 is coupled to crank 63 at one end with the remaining end coupled to clamp 66 via an aperture 67 formed therein.

In operation, levers 50 and 60 operate in the manner described above to extend or retract clamps 56 and 66 respectively. Thus, with lever 60 in the closed or retracted position shown in FIG. 5, clamp 66 is drawn fully inwardly. Conversely, clamp 56 is shown in the open or extended position in FIG. 5. Rotation of lever 50 in the direction indicated by arrow 94 rotates crank 53 in the direction indicated by arrow 95. This in turn, draws clamp 56 inwardly within channel 71 in the direction indicated by arrow 96 to provide the above described clamping function for securing the end portion of a sandpaper sheet as described above in FIG. 4.

In accordance with a further advantage of the present invention structure, it will be appreciated that the use of offset cranks and over-center latching action of the present invention clamping mechanism greatly simplifies the mechanism and allows a reliable and secure attachment of a sandpaper sheet. It will be further appreciated that the mechanism described herein for clamping the sandpaper is fabricated of parts which may be readily emerged in water and which are not degraded by such emersion. Toward this end, the simple but innovative over-center action of the clamp mechanisms avoids the need for more complex apparatus which would be more likely to be degraded or even damaged by repeated emersion in water.

What has been shown is a novel sanding block having a contoured grip which includes a simplified clamping mechanism for securing a sandpaper sheet. The apparatus shown is formed largely of molded plastic components and is fabricated utilizing a minimum number of parts. The design of the sanding block shown takes great care in avoiding the possibilities of injury to the user's hands while simultaneously fostering a secure but comfortable grip upon the sanding block.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A sanding block comprising:

an elongated hand grip defining a pair of opposed ends, a convex raised portion, a pair of concave portions on each end thereof and a pair of raised ends;

an elongated base housing secured to said hand grip and having a pair of angled end surfaces aligned with said opposed ends of said hand grip and having a support surface;

a pair of retractable sandpaper clamps supported at said opposed ends each movable within said elongated hand grip and said elongated base housing between an extended position spaced from said angled end surfaces and a retracted position against said angled end surfaces; and a pair of lever means each operatively coupled to one of said retractable sandpaper clamps for moving said one of said retractable sandpaper clamps between said retracted and extended position, said lever means each including an over-center latch for securing said one of said sandpaper clamps in said retracted position.

2. The sanding block set forth in claim 1 wherein said elongated base housing further includes a pair of guard surfaces each positioned at the general center of said elongated base housing.

3. The sanding block set forth in claim 2 wherein said support surface is generally planar.

4. The sanding block set forth in claim 3 further including a resilient pad secured to said support surface.

5. The sanding block set forth in claim 4 wherein said elongated hand grip defines a pair of inwardly extending opposed concave portions positioned on opposite sides of said convex raised portion.

6. The sanding block set forth in claim 1 wherein said elongated hand grip defines a pair of inwardly extending opposed concave portions positioned on opposite sides of said convex raised portion.

7. The sanding block set forth in claim 6 wherein said elongated base housing further includes a pair of guard surfaces each positioned at the general center of said elongated base housing.

8. The sanding block set forth in claim 7 wherein said support surface is generally planar.

9. A sanding block comprising:

a elongated hand grip defining a pair of opposed ends, a convex raised portion, a pair of concave portions on each end thereof and a pair of raised ends;

an elongated base housing secured to said hand grip and having a pair of angled end surfaces aligned with said opposed ends of said hand grip and having a support surface;

a pair of retractable sandpaper clamps supported at said opposed ends each movable between an extended position and a retracted position;

a pair of lever means each operatively coupled to one of said retractable sandpaper clamps for moving said retractable sandpaper clamps between said retracted and extended positions; and said lever means each including an over-center latch for securing said retractable sandpaper clamps in said retracted positions, wherein said hand grip defines an interior buoyancy cavity sufficient in volume to cause said sanding block to float in water.

10. The sanding block set forth in claim 9 wherein said interior buoyancy cavity is generally filled with a low-density foam material.

11. A sanding block comprising:

an elongated hand grip having a generally centered convex portion, a pair of ends and a lower surface;

an elongated base housing having a support surface and opposed ends, said elongated base housing being joined to said lower surface;

a pair of internal cavities formed between said hand grip and base housing;

a pair of channels extending inwardly from said pair of ends to said internal cavities;

a pair of levers each rotatably supported for rotation in a closure direction and in an open direction by said hand grip and said base housing and a pair of offset crank shafts each joined to one of said levers and each extending into said internal cavities;

a pair of sandpaper clamps slidably supported in said channels each having a sandpaper gripping outer end and an interior end;

a pair of springs each coupled between one of said crank shafts and one of said interior ends; and stop means limiting rotation of said levers in said closure direction, said pair of levers and said crank shafts and stop means and said springs cooperating to latch said sandpaper clamps in an over-center action.

12. The sanding block set forth in claim 11 wherein said elongated base housing further includes a pair of guard surfaces each positioned at the general center of said elongated base housing.

13. The sanding block set forth in claim 12 wherein said support surface is generally planar.

14. The sanding block set forth in claim 13 further including a resilient pad secured to said support surface.

15. The sanding block set forth in claim 14 wherein said hand grip defines an interior buoyancy cavity sufficient in volume to cause said sanding block to float in water.

16. The sanding block set forth in claim 15 wherein said interior buoyancy cavity is generally filled with a low-density foam material.

* * * * *